US007311156B2

(12) United States Patent
Edscer

(10) Patent No.: US 7,311,156 B2
(45) Date of Patent: Dec. 25, 2007

(54) FORWARD DRIVING SYSTEM FOR USE IN DRILLING MASONRY STRUCTURES

(76) Inventor: William George Edscer, Oldlands Farm, Fairwarp, Uckfield, East Sussex TN22 4BY (GB)

( * ) Notice: Subject to any disclaimer, the term of this patent is extended or adjusted under 35 U.S.C. 154(b) by 503 days.

(21) Appl. No.: 10/870,594

(22) Filed: Jun. 16, 2004

(65) Prior Publication Data

US 2004/0256158 A1 Dec. 23, 2004

(30) Foreign Application Priority Data

Jun. 19, 2003 (GB) ..... 0314266.8

(51) Int. Cl.
*E21B 7/00* (2006.01)

(52) U.S. Cl. ..... 175/57; 175/61; 175/73

(58) Field of Classification Search ..... None
See application file for complete search history.

(56) References Cited

U.S. PATENT DOCUMENTS 4,072,353 A * 2/1978 Clark et al. ..... 299/22
4,416,339 A 11/1983 Baker et al.
4,444,279 A * 4/1984 Kessler et al. ..... 175/202
5,553,678 A 9/1996 Barr et al.
6,564,871 B1 5/2003 Roberts
7,070,376 B1 * 7/2006 Toback ..... 411/82.2

FOREIGN PATENT DOCUMENTS

| | | |
|---|---|---|
| DE | 409 611 | 2/1925 |
| DE | 80 29 444 | 11/1982 |
| DE | 198 10 806 | 10/1999 |
| DE | 101 52 446 | 2/2003 |
| FR | 881 843 | 5/1943 |
| WO | 01/79649 | 10/2001 |

* cited by examiner

*Primary Examiner*—Frank Tsay
(74) *Attorney, Agent, or Firm*—Smith-Hill and Bedell

(57) ABSTRACT

A method of drilling through a masonry structure 20 includes the steps of providing a drill 10 and using the drill 10 to drill a bore 18 in the masonry structure 20. The method also includes a step of providing a reaction member in the form of a lever 28 and causing engagement of the lever 28 with the masonry structure 20 and with the drill 10 within the masonry structure 20 such that the lever 28 may provide a reaction force to assist the movement of the drill 10 through the structure 20 as it drills the bore 18.

38 Claims, 8 Drawing Sheets

FORWARD DRIVING SYSTEM FOR USE IN DRILLING MASONRY STRUCTURES

CROSS REFERENCE TO RELATED APPLICATION

This application claims priority under 35 USC 119 of United Kingdom Patent Application No. 0314266.8 filed Jun. 19, 2003.

BACKGROUND OF THE INVENTION

The invention relates to a forward drive apparatus and method for use in the drilling of masonry structures. The invention is of particular application when drilling curved paths through masonry structures.

International patent application WO/0179649 (in the name of the present applicant) discloses various apparatus for drilling curved paths through masonry structures. The applicant has realised that one difficulty when drilling curved paths is that of providing the necessary reaction force for the drill to enable it to move forward through the masonry structure.

SUMMARY OF THE INVENTION

According to the invention there is provided a method of drilling through a masonry structure, the method including the steps of:

providing drilling means and using the drilling means to drill a bore in the masonry structure;

providing a reaction member;

causing engagement of the reaction member with the masonry structure and with the drilling means within the masonry structure, such that the reaction member may provide a reaction force to assist the movement of the drilling means through the structure as it drills the bore.

The movement may be assisted by using the reaction force to propel the drilling means through the masonry structure, and/or to alter its direction of movement.

Preferably the drilling means forms part of a drill including a drilling head and a shaft attached thereto.

Preferably the reaction member is inserted into the masonry structure separately from the drill.

Preferably the reaction member is elongate, and is inserted into the masonry structure in a direction generally along its length.

Preferably the reaction member is inserted into the masonry structure in a direction which is not parallel to the bore. Preferably the reaction member is inserted into the structure in a direction which is substantially transverse to the bore. The reaction member may also be inserted in a direction generally transverse to a surface of the structure. Preferably once inserted the reaction member is at least partly encased in the masonry structure such that the masonry resists movement of the reaction member in a direction transverse to its direction of insertion into the structure. Preferably the reaction member is encased in the masonry structure such that the masonry resists movement of the reaction member in a direction substantially parallel to the bore.

The bore is preferably curved, and the masonry structure may be a masonry arch. The reaction member may be inserted into the structure from an underside of the arch.

The method preferably includes the step of initially drilling a hole for the reaction member and then inserting the reaction member into the hole. Preferably the hole extends in a direction which is not parallel to the bore. Preferably the hole extends from a surface of the structure towards the drill or the bore. The hole may meet the bore.

The hole may comprise a slot formed by removing mortar from between adjacent layers of masonry members such as bricks. Alternatively the hole may comprise a bore produced by a drill.

The hole for the reaction member may increase in diameter as it extends into the structure towards the drill or bore. The method may include the step of inserting the reaction member into the hole, bringing the reaction member into engagement with the drill and exerting a backward force on a part of the reaction member located externally of the masonry structure in order to impart a forwardly directed force to the drill, to lever the drill forward.

The method may include the step of providing a gear on the reaction member which engages external grooves on the drill such that rotation of the reaction member causes forward movement of the drill.

The method may include the step of providing the reaction member with a head including an opening through which the drill may pass. The head may include an annular or part-annular member, which may have an internal thread, the internal thread being adapted for engagement with a complementary thread on the drill. Preferably, on rotation of the drill, engagement of the respective threads on the drill and the head causes movement of the drill through the head, the reaction member providing a reaction force to assist the movement.

The reaction member may form part of a drill. The method may include the step of providing a drill including an externally threaded part and a reaction member in the form of a collar including an internal thread, the collar surrounding and engaging the externally threaded part. The method may include the step of selectively securing the collar in place within the bore and causing the externally threaded part of the drill to rotate and thereby move forwards, the collar providing a reaction force. The method may include the step of rotating the drill in a direction opposite from the drilling direction in order to cause a cam associated with the collar to engage against internal walls of the bore, thereby securing the collar in place.

In a further embodiment in which the reaction member forms part of the drill, the method includes the step of providing a drill including an inner shaft and a concentric outer shaft, the shafts being selectively rotatable either together or independently. The reaction member may be provided on the outer shaft and may be moveable between a passive position and an active position in which it engages the masonry structure and provides the reaction force. Preferably in the active position, the reaction member engages an inner wall of the bore. Preferably the reaction member is biased into the passive position and the method includes the step of moving the reaction member into the active position by causing relative movement of the inner and outer shafts.

The inner shaft may be provided with a radially extending protrusion capable of pushing the reaction member into the active position. Preferably the method includes the step of causing relative movement of the inner and outer shafts to bring the radial protrusion into a position in which it pushes the reaction member into its active position.

According to the invention there is further provided an apparatus for drilling through masonry structure, the apparatus including:

drilling means for drilling a bore in the masonry structure; and a reaction member adapted for engagement with the masonry structure and with the drilling means at a position within the masonry structure, to provide a reaction force to assist movement of the drilling means through the structure, as it drills the bore.

Preferably the drilling means forms part of a drill including a drilling head and a shaft attached thereto.

Preferably the reaction member is adapted for insertion into the masonry structure separately from the drill. Preferably the reaction member is adapted for insertion through a hole in the structure in a direction generally transverse to the bore.

Preferably the drill is adapted to drill a curved path through the structure. Preferably the shaft is flexible.

The reaction member may include an end which is adapted to engage a hole or groove in the drill such that the reaction member may be used to lever the drill forward along the general path of movement of the drill through the structure.

The drill may be provided with external grooves or threads. These may be provided on the drill head or on a drill body located behind the drill head.

The reaction member may include a gear which is able to engage the grooves or thread of the drill such that rotation of the reaction member causes movement of the drill along the drilling path. The reaction member preferably includes an elongate shaft, the gear being provided at an end of a shaft. Preferably the gear teeth project in a direction generally parallel to the shaft and rotation of the shaft about its own axis causes the gear to rotate and thereby cause movement of the drill along the drilling path.

The reaction member may include a shaft and a head including an opening through which the drill may pass. The head may include an annular or part-annular member, which may have an internal thread, the internal thread being adapted for engagement with a complementary thread on the drill. Preferably, on rotation of the drill, engagement of the respective threads on the drill and the head causes movement of the drill along the drilling path through the head, the reaction member providing a reaction force to assist the movement.

The reaction member may form part of the drill. The drill may include an externally threaded part and a reaction member in the form of an internally threaded collar surrounding and engaging the externally threaded part. The drill may include means for securing the collar in place within the bore, enabling the externally threaded part to rotate and thereby move forwards, the collar providing a reaction force. These means may include a cam which is inactive when the drill is rotated in the normal drilling direction but which fouls against an inside of the bore drill when the drill is rotated in an opposite direction. The cam may be attached to the collar such that rotation of the drill in this opposite direction results in the collar being secured within the bore, thus enabling the threaded or grooved part of the drill to extend forwardly thereof.

In a further embodiment in which the reaction member forms part of the drill, the drill includes an inner shaft and a concentric outer shaft, the shafts being selectively rotatable either together or independently. The reaction member may be provided on the outer shaft and may be moveable between a passive position and an active position in which engages the masonry structure and provides the reaction force. Preferably in the active position, the reaction member engages on inner wall of the bore. Preferably the reaction member is biased into the passive position and the apparatus is configured such that the reaction member may be moved into the active position by causing relative movement of the inner and outer shafts.

The inner shaft may include a radially extending protrusion capable of pushing the reaction member into the active position. Preferably the apparatus is configured such that relative movement of the inner and outer shafts may bring the radial protrusion into a position in which it pushes the reaction member into its active position.

BRIEF DESCRIPTION OF THE DRAWINGS

Embodiments of the invention will be described for the purpose of illustration only with reference to the accompanying drawings in which.

DETAILED DESCRIPTION

The forward driving apparatus and method of invention is particularly applicable for use with the various drilling apparatus described in International patent application no. PCT/GB01/01735 (publication number WO/0179649). This patent application describes drilling apparatus which can be used to drill curved paths through masonry structures. Such apparatus is particularly useful for example when reinforcing curved masonry structures, such as masonry arched bridges. Using the drilling apparatus previously described, elongate bores may be drilled through such arched structures generally in line with the curvature of the arch, and reinforcing bars may be inserted in these bores. This method is described in patent no. GB 2,302,896, also in the name of the present applicant.

The applicant has realised that one difficulty when drilling a curved bore through a structure is that of providing the necessary reaction force to maintain the forward movement of the drill through the structure. Because of the curvature of the drilling path, it can be more difficult to provide such a reaction force down the shaft and therefore the masonry structure must be relied upon to provide the reaction force. However, such masonry structures are often relatively old and may not be sufficiently strong to provide this reaction force effectively. In addition, accurately controlling the direction of drilling can be difficult.

Figure 1:
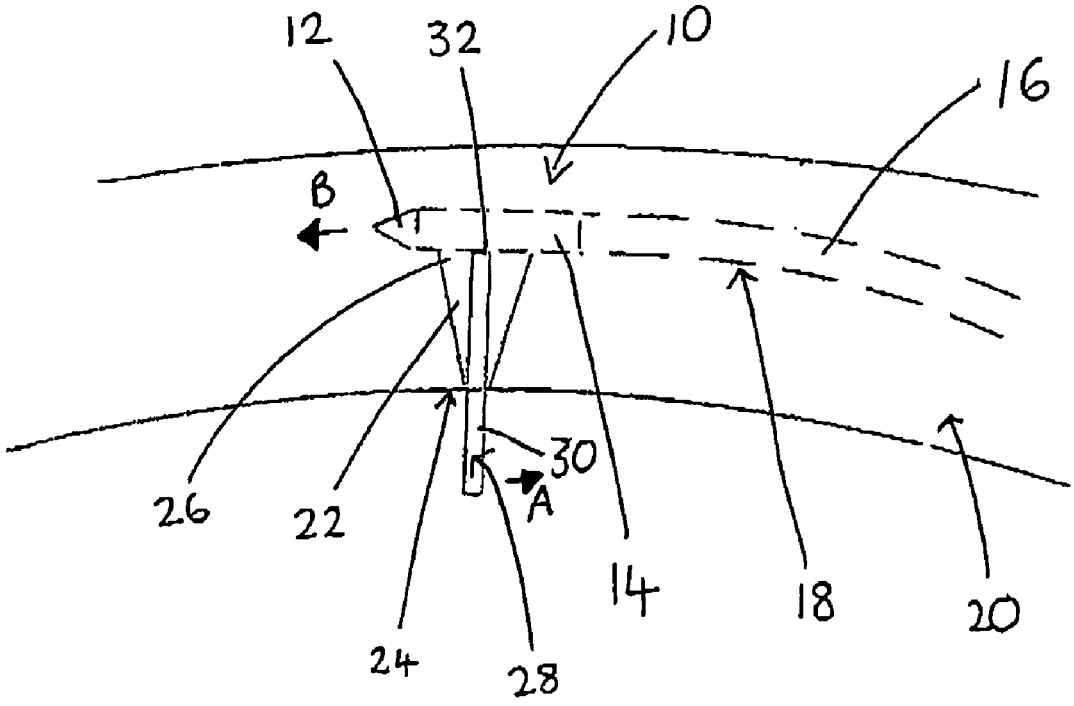
FIG. 1 is a diagrammatic sectional view of a first embodiment of the invention.

Referring to FIG. 1, there is illustrated a drill 10 including a drill head 12, a drill body 14 and a flexible drive 16. The drill 10 is shown part way through drilling a curved bore 18 through a curved masonry structure 20.

The forwardly directed force keeping the drill moving through the masonry is provided partly by the drilling action of the drill bit in the masonry and partly by a driving force along the flexible drive 16. However, particularly if a hard piece of masonry is encountered, this force may not be sufficient, and the drill may cease its forward movement or may start to move in the wrong direction. When this occurs, the method and apparatus of the invention allows the drill to be propelled forward, as follows.

It may be seen that a slot 22 has been drilled into the masonry structure 20, from its underside 24. In the illustrated embodiment, the slot 22 is narrow where it first enters the masonry structure 20 but opens out in a wedge shape towards a wide part 26, where the slot meets the bore 18. However, the slot may have parallel sides, for example if mortar is simply removed from between bricks.

A reaction member in the form of a lever 28 is provided within the slot 22. The reaction member includes a lower part 30 which protrudes from the slot and an end part 32 which may engage the drill 10 as described below.

Figure 5:
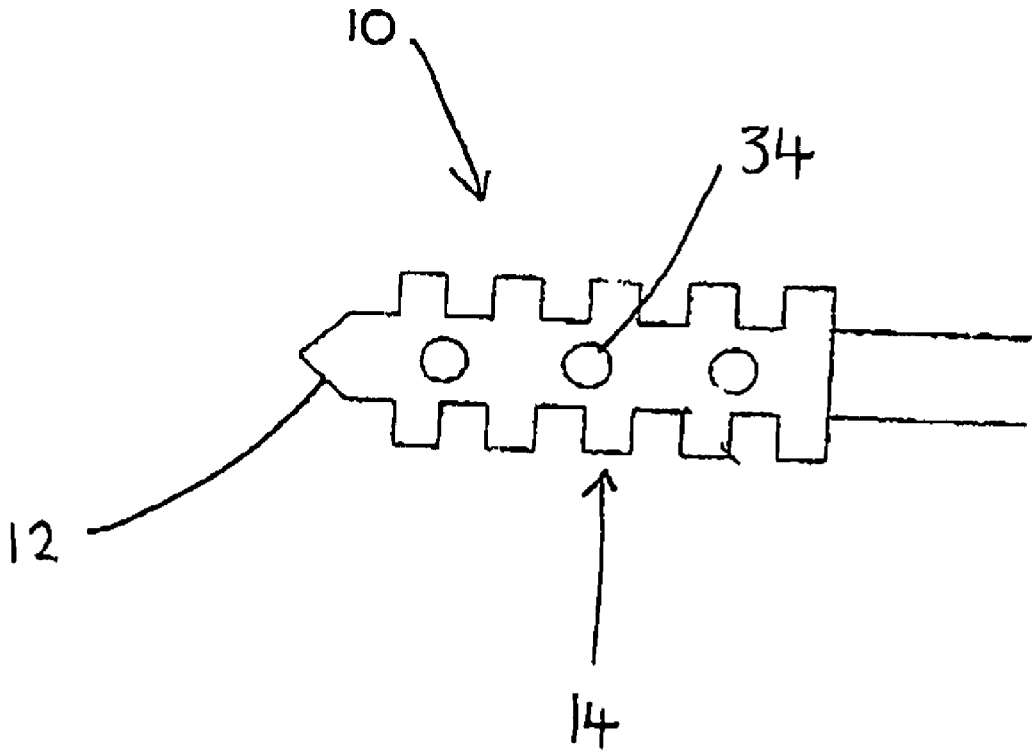
FIG. 5 is a diagrammatic sectional view of a drill head for use in accordance with various embodiments of the invention.

Referring to FIG. 5, the drill body 14 is provided with a number of holes 34, of generally complementary shape to the end part 32 of the lever. The end part 32 of the lever may thus be inserted into one of the holes 34, to form an engagement between the lever 28 and the drill body 14. Referring again to FIG. 1, with the drill 10 stationary the end part 34 is inserted into one of the holes 32, and the lower part 30 of the lever 28 is forced in the direction of the arrow A, causing the lever to pivot in the slot and urge the drill body 14 forwardly along its drilling path through the masonry structure (arrow B). The drill 10 may thereby be forced through any particularly hard areas of masonry, before normal drilling recommences. The drill may also be manipulated to change its direction if necessary.

Figure 2:
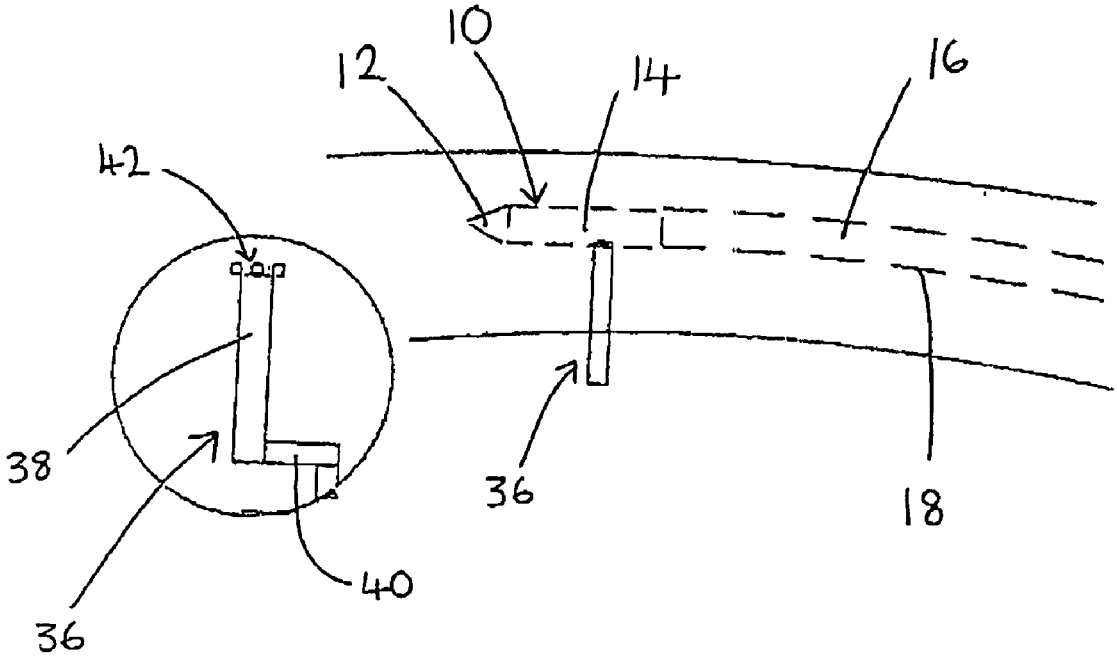
FIG. 2 is a diagrammatic sectional view of a second embodiment of the invention, with a detail of part of the reaction member enlarged.

Referring to FIG. 2, there is illustrated a second embodiment of the invention. Parts corresponding to those shown in FIG. 1 are given the same reference numerals. In the FIG. 2 embodiment, the apparatus includes a reaction member in the form of a gear rod 36. The gear rod includes a hollow shaft 38 provided with a handle 40 at one of its ends and a gear 42 at its other end.

The drill body 14 includes grooves or threads which can engage the teeth of the gear 42 such that when the handle 40 is used to rotate the shaft 38 about its own axis, the movement of the gear 42 causes forward movement of the drill 10 through the masonry structure.

Figure 3:
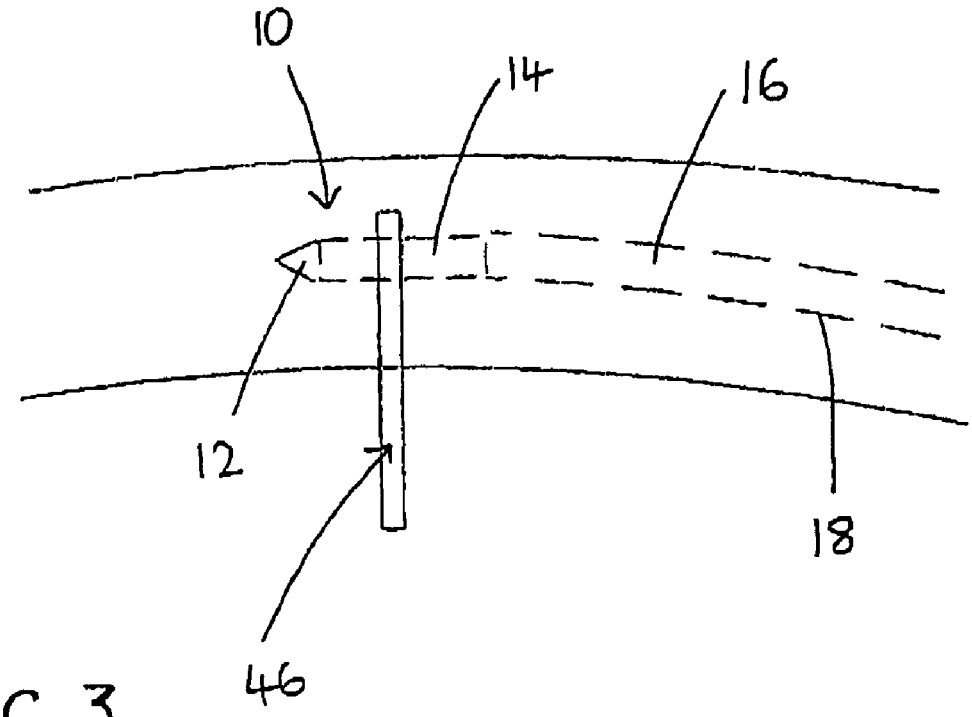
FIG. 3 is a diagrammatic sectional view of a third embodiment of the invention.
Figure 4:
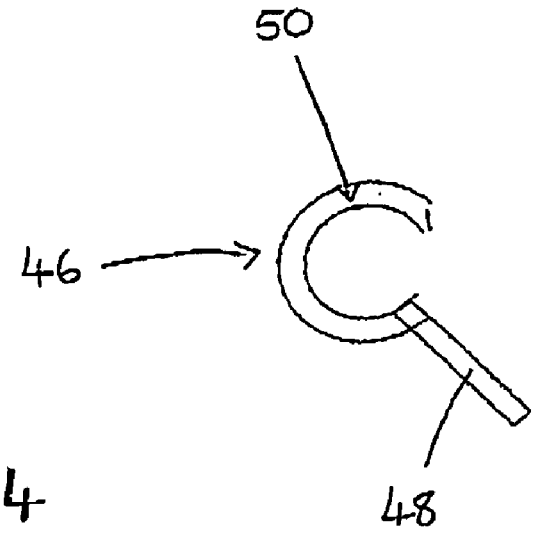
FIG. 4 is a diagrammatic side view of a reaction member for use with the embodiment of FIG. 3.

Referring to FIGS. 3 and 4, there is illustrated a further embodiment of the invention in which corresponding parts are again given the same reference numerals. In this embodiment, a reaction member in the form of a threaded guide 46 is provided. The threaded guide 46 includes an elongate shaft 48 and a ring member 50 which is part-annular shaped and internally threaded. The drill 10 for use in this embodiment of the invention includes an external thread on its body 14 (not visible in FIG. 3). The internal thread on the ring member 50 is able to engage with the external thread on the drill head 12.

In this embodiment of the invention, the threaded guide is first inserted through a hole 52 in the masonry structure before the drill is advanced forward such that its drill head 12 passes through the ring member 50 of the threaded guide 46 and its threaded drill body 14 comes into engagement with the thread on the member 50. Continued slow rotation of the drill causes it to advance in the forward direction, with the engagement of the drill body 14 with the internal thread on the annular member 50 providing a forward reaction force to maintain the forward movement, and to control the direction.

Figure 6A:
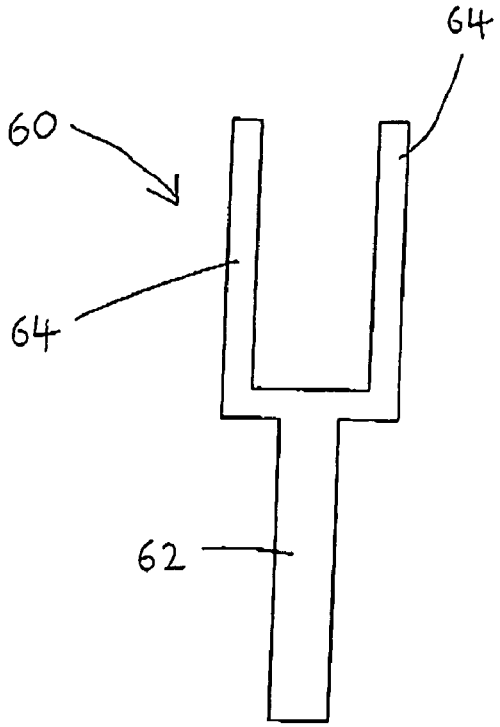
FIG. 6A and 6B are front and side views of an alternative reaction member.
Figure 6B:
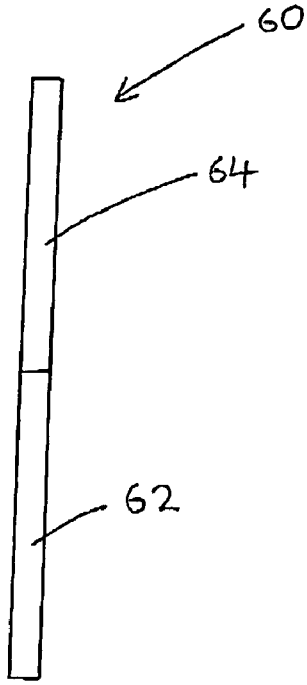

Referring to FIGS. 6A and 6B there is illustrated an alternative reaction member 60. The reaction member 60 includes an elongate shaft 62 and two prongs 64. The prongs 64 are able to embrace and engage a drill head 12 or drill body 14. The reaction member 60 may then be manipulated to urge the drill forwards as described previously.

Figure 7:
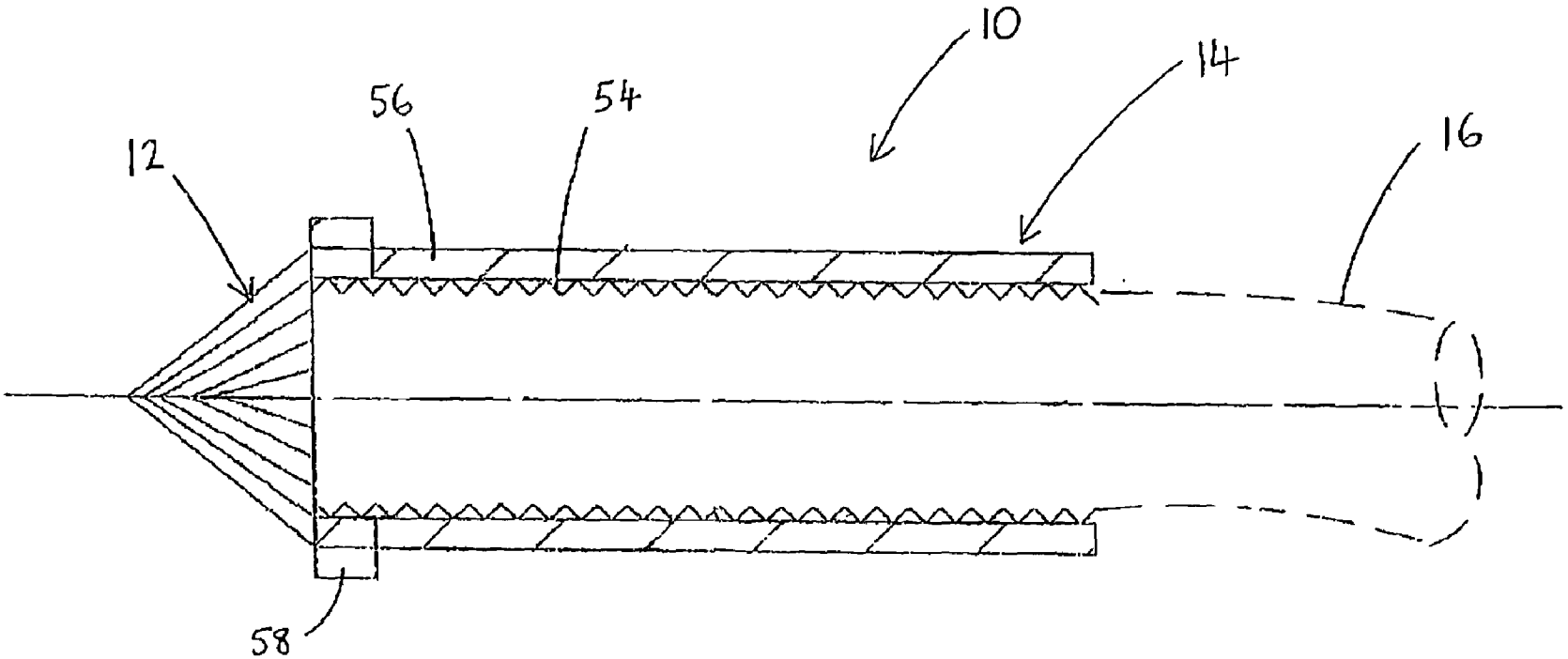
FIG. 7 is a diagrammatic sectional view of a drill according to a further embodiment of the invention.

FIG. 7 illustrates an alternative embodiment of drill 10 according to the invention. The drill 10 includes a drilling head 12, a drill body 14 and a flexible drive 16. The drill body 14 is provided with an external thread 54. A collar 56, which includes an internal thread, surrounds and engages the drill body 14. Thus in normal use the external thread of the drill body is not exposed.

The collar 56 further includes a retractable cam 58 similar to that described in more detail in earlier patent application number WO/0179649. When the drill 10 is used to drill normally through the masonry structure, its direction of rotation is such that the cam has no effect. However, if the drill is rotated in an opposite direction, the cam fouls against an internal wall of the bore drilled through the structure. This prevents further forward movement of the cam 58 and therefore the collar 56 until the drill direction is again reversed.

The drill of FIG. 7 may be used as follows. The drill 10 is used to drill through the structure in the normal way, with the drilling direction such that the cam remains in its neutral, inactive position. When the drill encounters a hard material such that an additional forward force is required, the drill initially stops. The direction of rotation may then be reversed to activate the cam 58 which secures the collar 56 in place within the bore. The drilling may then be resumed, using the opposite drilling direction to that used previously such that the cam 58 remains in engagement with the bore 18. This extends the drill body out in front of the collar, with the engagement of the cam against the internal walls of the drilling bore 18 causing the necessary reaction force. The drill 10 would include two shafts, an outer one to operate the cam 58 and an inner one to turn the drill head.

Figure 8A:
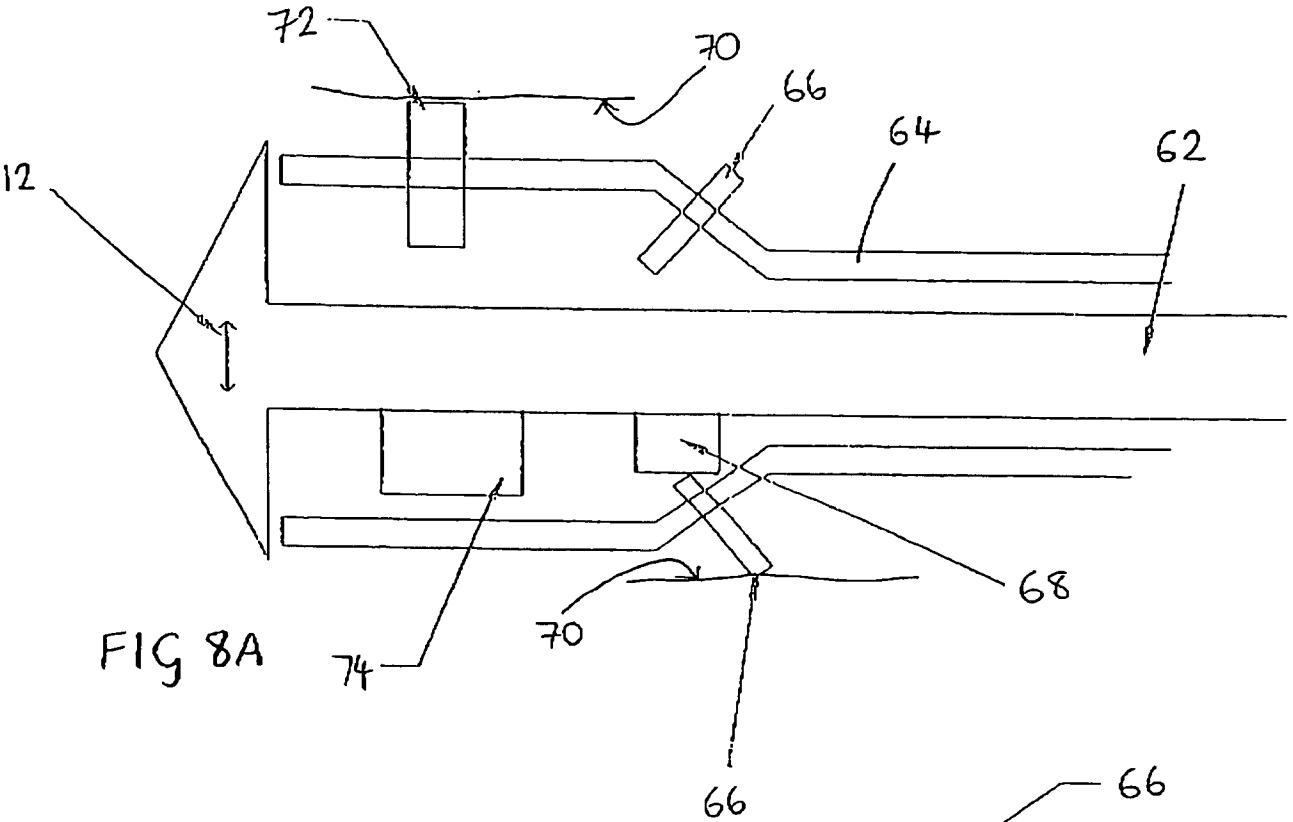
FIG. 8A is a diagrammatic sectional view of a drill according to a further embodiment of the invention.
Figure 8B:
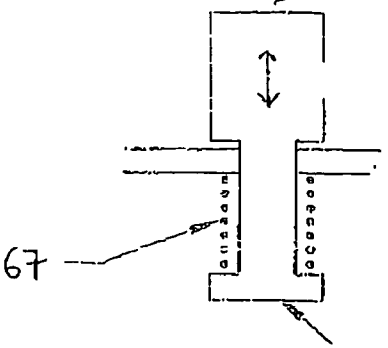
FIG. 8B is an enlarged detail in sectional view of the piston of FIG. 8A.

FIGS. 8A and 8B illustrate a further embodiment of a drill 10 according to the invention. The drill 10 includes a drilling head 12 and a flexible inner drive shaft 62 which drives the rotation of the head. The drilling head 12 may be rotated in either direction to drill through the structure. The drill 10 further includes an outer shaft 64, concentric with the shaft 62. The inner and outer shafts 62 and 64 may be caused to rotate together or independently.

The outer shaft 64 is provided with a reaction member in the form of a piston 66 (see the detailed view in FIG. 8B). The piston 66 is moveable between a passive position illustrated by the piston shown at the top of FIG. 8, and an active position illustrated by the piston shown at the bottom of FIG. 8. The piston is biased by a compression spring 67 (see FIG. 8B) into the passive position.

The inner shaft 62 is provided with a radial projection in the form of a cam 68. When the cam 68 is radially aligned with the piston 66, it causes the piston 66 to move from its passive position to its active position. As such movement takes place, the piston engages and pushes against an internal wall 70 of the bore.

The drill of FIGS. 8A and 8B may be used as follows. The drill 10 is used to drill through the structure in the normal way, with the inner shaft 62 and outer shaft 64 being caused to rotate together, The relative positions of these shafts are such that the cam 68 does not engage the piston 66 and the piston 66 remains in its passive position. When the drill 10 encounters a hard material such that an additional forward force is required, the drill initially stops. At this time, the outer shaft 64 may be caused to stop rotating, and the inner shaft 62 rotated slowly, thereby causing relative moment of the inner and outer shafts. This brings the cam 68 into a position in which it pushes the piston 66 into its active position. This causes a reaction force against an inner wall 70 of the bore, thereby propelling the drill 10 forwards within the bore.

As an alternative or in addition to the piston 66, the drill 10 may be provided with a side piston 72 which may be caused by a cam 74 to extend outwardly against the inner wall 70 of the bore, thereby causing a sideways movement of the drill 10, to assist a change in direction.

There are thus provide various embodiments of an apparatus and method for providing a forward reaction force for drilling through masonry structures.

Figure 9:
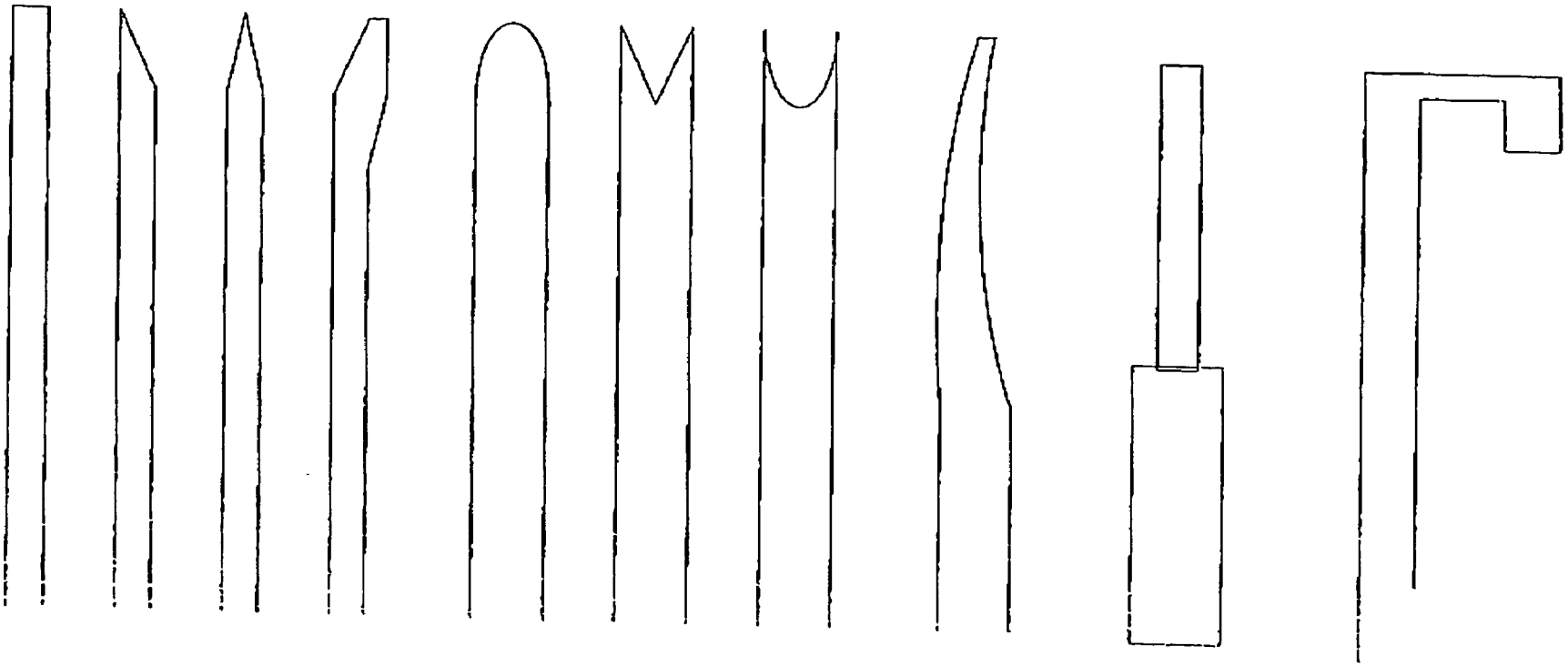
FIG. 9 illustrates in section the ends of various different shapes of reaction member.

Various modifications may be made to the above described embodiment without departing from the scope of the invention. For example various different shapes of reaction member end are illustrated in FIG. 9.

The flexible drive 16 may have a hollow centre for fluid supply to the drill head 12 and/or for waste removal from the drill head, or to contain cable, fibre optic or other communication cables. Internal tubing may be provided within the flexible drive 16 for air or fluid transfer to power the drill head, for hydraulic or air-powered motors.

The drilling head 12 may be steered by cams activated by the shaft or by pressure of water, air, gas, etc, or by pressure jets located in the head. Alternatively the drill head 12 may be steered by offset pilot drills in the main bore head or by radio controlled, X-ray, radar or similar guidance systems.

The drill head may further include radio controlled detection systems or may react with remote sensors on reaction members inserted in the masonry to allow the drill head to find and locate with the reaction member. The drill head may be powered by a drive motor incorporated in the head driven by air, water, electricity, etc. This may have radio, magnetic, electrical, air, water, gas, or fibre optic operated controls. It may relate with the reaction member to guide the drill head and provide feedback in the same way. The head may further communicate with a control centre by radio waves, electricity, fibre optics or through pressure plates/indicators/sensors to allow monitoring of the progress and location of the drill head. The drill head may alternatively communicate with the control centre through communication by a central cable located in the flexible drive shaft.

The reaction member may contain radio wave, radar, magnetic or electrical sensors and transmitter and locating devices to allow the plotting of each position. The reaction member may also provide guidance to drill head and remote operator by transmitting signals. The reaction member may be inserted into the masonry ahead of the drill head and may be used to inject glues, grouts or other materials, or to drain off water and waste materials, Further it may be used as an injection ports to facilitate material injection.

Whilst endeavouring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. A method of drilling through a masonry structure, the method including the steps of:

providing drilling means which form part of a drill including a drilling head and a shaft attached thereto and using the drilling means to drill a bore in the masonry structure;

providing a reaction member;

inserting the reaction member into the masonry structure separately from the drill; and causing engagement of the reaction member with the masonry structure and with the drilling means within the masonry structure, such that the reaction member may provide a reaction force to assist the movement of the drilling means through the structure as it drills the bore.

2. A method according to claim 1 wherein the reaction member is elongate, and is inserted into the masonry structure in a direction generally along its length.

3. A method according to claim 2 wherein the reaction member is inserted into the masonry structure in a direction which is not parallel to the bore.

4. A method according to claim 3 wherein the reaction member is inserted into the structure in a direction which is substantially transverse to the bore.

5. A method according to claim 2 wherein the reaction member is inserted in a direction generally transverse to a surface of the structure.

6. A method according to claim 2 wherein once inserted the reaction member is at least partly encased in the masonry structure such that the masonry resists movement of the reaction member in a direction transverse to its direction of insertion into the structure.

7. A method according to claim 6 wherein the reaction member is encased in the masonry structure such that the masonry resists movement of the reaction member in a direction substantially parallel to the bore.

8. A method according to claim 1 wherein the bore is curved, the masonry structure is a masonry arch and the reaction member is inserted into the structure from an underside of the arch.

9. A method according to claim 1 wherein the method includes the step of initially drilling a hole for the reaction member and then inserting the reaction member into the hole.

10. A method according to claim 9 wherein the hole extends in a direction which is not parallel to the bore, extending from a surface of the structure towards the drill or the bore.

11. A method according to claim 10 wherein the hole meets the bore.

12. A method according to claim 9 wherein the hole comprises a slot formed by removing mortar from between adjacent layers of masonry members such as bricks.

13. A method according to claim 9 wherein the hole for the reaction member increases in diameter as it extends into the structure cowards the drill or bore.

14. A method according to claim 13 wherein the method includes the step of inserting the reaction member into the hole, bringing the reaction member into engagement with the drill and exerting a backward force on a part of the reaction member located externally of the masonry structure in order to impart a forwardly directed force to the drill, to lever the drill forward.

15. A method according to claim 14 wherein the method includes the step of providing a gear on the reaction member which engages external grooves on the drill such that rotation of the reaction member causes forward movement of the drill.

16. A method according to claim 14 wherein the method includes the step of providing the reaction member with a threaded guide including an opening through which the drill may pass.

17. A method according to claim 16 wherein the threaded guide includes an annular or part-annular member, which has an internal thread, the internal thread being adapted for engagement with a complementary thread on the drill.

18. A method according to claim 17 wherein on rotation of the drill, engagement of the respective threads on the drill and the threaded guide causes movement of the drill through the head, the reaction member providing a reaction force to assist the movement.

19. An apparatus for drilling through masonry structure, the apparatus including:

drilling means for drilling a bore in the masonry structure, the drilling means forming part of a drill including a drilling head and a shaft attached thereto; and a reaction member configured for insertion into the masonry structure separately from the drill, and adapted for engagement with the masonry structure and with the drilling means at a position within the masonry structure, to provide a reaction force to assist movement of the drilling means through the structure, as it drills the bore.

20. An apparatus according to claim 19 wherein the drill is adapted to drill a curved path through the structure, and the shaft is flexible.

21. An apparatus according to claim 19 wherein the reaction member includes an end which is adapted to engage a hole or groove in the drill such that the reaction member may be used to lever the drill forward along the general path of movement of the drill through the structure.

22. An apparatus according to claim 21 wherein the drill is provided with external grooves or threads.

23. An apparatus according to claim 22 wherein the reaction member includes a gear which is able to engage the grooves or thread of the drill such that rotation of the reaction member causes movement of the drill along the drilling path.

24. An apparatus according to claim 23 wherein the reaction member includes an elongate shaft, the gear being provided at an end of a shaft, the gear teeth projecting in a direction generally parallel to the shaft and rotation of the shaft about its own axis causing the gear to rotate and thereby cause movement of the drill along the drilling path.

25. An apparatus according to claim 22 wherein the reaction member includes a shaft and a head including an opening through which the drill may pass.

26. An apparatus according to claim 25 wherein the head includes an annular or part-annular member, which has an internal thread, the internal thread being adapted for engagement with a complementary thread on the drill, so that on rotation of the drill, engagement of the respective threads on the drill and the head causes movement of the drill along the drilling path through the head, the reaction member providing a reaction force to assist the movement.

27. A method of drilling through a masonry structure, the method including the steps of:

providing drilling means which form part of a drill including a drilling head and a shaft attached thereto and using the drilling means to drill a bore in the masonry structure;

wherein the drill includes an externally threaded part and a reaction member in the form of a collar including an internal thread, the collar surrounding and engaging the externally threaded part, and the method includes the step of causing engagement of the collar with the masonry structure and with the drilling means within the masonry structure, such that the collar may provide a reaction force to assist the movement of the drilling means through the structure as it drills the bore.

28. A method according to claim 27 including the step of selectively securing the collar in place within the bore and causing the externally threaded part of the drill to rotate and thereby move forwards, the collar providing a reaction force.

29. A method according to claim 28 including the step of rotating the drill in a direction opposite from the drilling direction in order to cause a cam associated with the collar to engage against internal walls of the bore, thereby securing the collar in place.

30. An apparatus for drilling through masonry structure, the apparatus including drilling means forming part of a drill including a drilling head and a shaft attached thereto, for drilling a bore in the masonry structure;

wherein the drill includes an externally threaded part and a reaction member in the form of a collar including an internal thread, the collar surrounding and engaging the externally threaded part, so that the collar may engage the masonry structure to provide a reaction force to assist movement of the drilling means through the structure as it drills the bore.

31. An apparatus according to claim 30 wherein the drill includes means for securing the collar in place within the bore, enabling the externally threaded part to rotate and thereby move forwards, the collar providing a reaction force.

32. An apparatus according to claim 31 wherein the means for securing the collar in place includes a cam which is inactive when the drill is rotated in the normal drilling direction but which fouls against an inside of the bore drill when the drill is located in an opposite direction, the cam being attached to the collar such that rotation of the drill in this opposite direction results in the collar being secured within the bore, thus enabling the threaded or grooved part of the drill to extend forwardly thereof.

33. A method of drilling through a masonry structure, the method including the steps of:

providing drilling means which form part of a drill including a drilling head and a shaft attached thereto and using the drilling means to drill a bore in the masonry structure;

providing a reaction member;

causing engagement of the reaction member with the masonry structure and with the drilling means within the masonry structure, such that the reaction member may provide a reaction force to assist the movement of the drilling means through the structure as it drills the bore;

wherein the reaction member forms part of a drill including an inner shaft and a concentric outer shaft, the shafts being selectively rotatable either together or independently, and the reaction member is provided on the outer shaft and is moveable between a passive position and an active position in which it engages the masonry structure and provides the reaction force.

34. A method according to claim 33 wherein in the active position, the reaction member engages an inner wall of the bore, the reaction member is biased into the passive position and the method includes the step of moving the reaction member into the active position by causing relative movement of the inner and outer shafts.

35. A method according to claim 34 wherein the inner shaft is provided with a radially extending projection capable of pushing the reaction member into the active position, and the method includes the step of causing relative movement of the inner and outer shafts to bring the radial protrusion into a position in which it pushes the reaction member into its active position.

36. An apparatus for drilling through masonry structure, the apparatus including:

drilling means which form part of a drill including a drilling head and a shaft attached thereto, for drilling a bore in the masonry structure; and a reaction member adapted for engagement with the masonry structure and with the drilling means at a position within the masonry structure, to provide a reaction force to assist movement of the drilling means through the structure, as it drills the bore;

wherein the reaction member forms part of the drill, and the drill includes an inner shaft and a concentric outer shaft, the shafts being selectively rotatable either together or independently, and the reaction member is provided on the outer shaft and is moveable between a passive position and an active position in which it engages the masonry structure and provides the reaction force.

37. An apparatus according to claim 36 wherein the reaction member is configured to engage and inner wall of the bore in the active position.

38. An apparatus according to claim 37 wherein the reaction member is biased into the passive position and the apparatus is configured such that the reaction member is moved into the active position by causing relative movement of the inner and outer shafts.

* * * * *